US010253688B2

(12) United States Patent
Arboleda

(10) Patent No.: US 10,253,688 B2
(45) Date of Patent: Apr. 9, 2019

(54) COMPRESSION RATE REDUCTION PROCESS BY ADDING COLD MATERIAL AT THE CYLINDER HEAD OF ENGINES CONVERTED TO NATURAL GAS TO BE USED AS FUEL

(71) Applicants: UNIVERSIDAD TECNOLOGICA DE PEREIRA, Pereira, Risaralda (CO); Luis Guillermo Gaviria Arboleda, Pereira, Risaralda (CO)

(72) Inventor: Luis Guillermo Gaviria Arboleda, Risaralda (CO)

(73) Assignees: UNIVERSIDAD TECNOLOGICA DE PEREIRA, Pereira, Risaralda (CO); Luis Guillermo Gaviria Arboleda, Pereira, Risaralda (CO)

( * ) Notice: Subject to any disclaimer, the term of this patent is extended or adjusted under 35 U.S.C. 154(b) by 0 days.

(21) Appl. No.: 15/656,488

(22) Filed: Jul. 21, 2017

(65) Prior Publication Data

US 2018/0045111 A1 Feb. 15, 2018

(30) Foreign Application Priority Data

Jul. 22, 2016 (CO) ..... NC2016/0000102

(51) Int. Cl.
*F02B 69/04* (2006.01)
*F02F 1/24* (2006.01)

(52) U.S. Cl.
CPC ..... *F02B 69/04* (2013.01); *F02F 1/24* (2013.01); *F02F 2200/00* (2013.01)

(58) Field of Classification Search
CPC ..... F02B 69/04; F02B 3/06
See application file for complete search history.

(56) References Cited

U.S. PATENT DOCUMENTS 4,330,732 A * 5/1982 Lowther ..... F02P 15/04 123/143 R
5,271,967 A * 12/1993 Kramer ..... C23C 4/12 29/888.061
7,019,626 B1 3/2006 Funk
9,803,271 B2 * 10/2017 Bluemlhuber ..... B23K 9/048
2001/0049936 A1 * 12/2001 Kenneth ..... B01D 53/944 60/299
2003/0089346 A1 5/2003 Burkhart
2010/0316798 A1 * 12/2010 Takahashi ..... B05B 13/0618 427/236

OTHER PUBLICATIONS

"Green Energy Perú," http://www.greenenergyperu.com.pe/, 2012, 2 pages (4 pages total), with English translation.
Agesel S.A. Peru, "Conversión de Motores Diesel a Gas Natural (GNV/GNC) en Buses—Agesel S.A.," https://www.youtube.com/watch?v=heTv1uSizzo, Dec. 10, 2012, 4 pages, with English abstract.

* cited by examiner

*Primary Examiner* — Long T Tran
(74) *Attorney, Agent, or Firm* — Birch, Stewart, Kolasch & Birch, LLP

(57) ABSTRACT

One of the processes needed for the conversion of a diesel engine so that it can use natural gas as fuel is the reduction of the compression ratio, since the one that the diesel engine originally has is greater than the one needed for the optimal operation with natural gas.

The proposed process consists of adding cold material to the cylinder head or engine head through metallization or electric arc or plasma spraying to form a combustion chamber therein.

4 Claims, 2 Drawing Sheets

COMPRESSION RATE REDUCTION PROCESS BY ADDING COLD MATERIAL AT THE CYLINDER HEAD OF ENGINES CONVERTED TO NATURAL GAS TO BE USED AS FUEL

FIELD OF THE INVENTION

This invention relates to diesel engines converted to natural gas by a compression ratio reduction process by adding cold material at the cylinder head without the need for internal engine modifications, thus reducing costs and installation times. The method claimed in the present invention consist of increasing the size of the combustion chamber over the engine head, without affecting the structural reliability of the engine and allowing the process to be reversible compared to processes requiring internal engine modifications.

BACKGROUND OF THE INVENTION

According to studies developed by the Ministry of Mines and Energy of Colombia, due to high prices of liquid fuels for external factors, Natural Gas Vehicle (NGV) emerged as an alternative, which has led to different actions by the Government and Entities such as Ecopetrol and Eicogas, among others, that seek to encourage the number of conversions to natural gas vehicle as a strategy to massify its use and replace the use of other more expensive fuels such as gasoline, Diesel Oil, among others.

At present, Natural Gas Vehicle (NGV) has gained greater relevance regarding the increase of costs of fuels derived from petroleum, as, through the use of natural gas, it produces less harmful substances to the environment, provides a longer shelf life of the engine's oil, the operation of natural gas engines is smoother compared to diesel and therefore less noisy, among other advantages.

Given the current demand for natural gas-fueled engines, as they produce much less $CO_2$ pollution compared to diesel engines, there have been proposed different alternative engines allowing their operation by varying the input fuel. This led, not only in Colombia, but also worldwide, to the conversion of diesel-type engines to natural gas, a process known as conversion (there can be found extensive information on how to conducted it). One of the requirements of this process consists in the reduction of the compression ratio to allow an optimal combustion with the new fuel.

The reduction of the compression ratio of the engine is widely used worldwide by engineers of high performance engines, information of which is documented in forums and websites specialized in the field. However, there is no evidence that the reduction of the compression ratio can be made by a process that reversibly modifies the engine head. Similarly, and despite the evidences in the processes published in documents that are made to reduce the compression ratio, there is no single reference mentioning that said process can be carried out by metallization of the cylinder head and less that this process can be carried out for the conversion of diesel engines to natural gas.

Werner Funk et al. in the U.S. Pat. No. 7,019,626 B1 patent discloses the design of engines that can run on different types of fuels, whether diesel or a second fuel such as natural gas, propane, or hydrogen. However, the conversion of a multi-fuel engine requires modification of the engine including an indicator that indicates how much second fuel is being combusted relative to the diesel or gasoline, as well as an oil control unit of the fuel pump and a control unit for the metering of the second fuel. While this document relates to an engine that can be used on two different fuels, it does not provide the possibility to reuse the engine exclusively for diesel fuel since it requires internal drastic structural changes on said engine.

Likewise, a process for the conversion of a diesel engine to natural gas has been disclosed in US20030089346 A1, where inserting a spark plug into the fuel injection system for the use of natural gas is proposed, which also requires the installation of a throttle body in the diesel engine, the installation of an accelerator body adapter between an accelerator body and an intake manifold of said diesel engine and modification of the piston so that the compression ratio reduces and improves efficiency when the fuel is natural gas. Although this invention also seeks to reduce the compression ratio by modifying the pistons by removing part of the material therein, it has to be taken into account that multiple internal modifications of the engine for its transformation will obviously lead to high production and assembly costs.

The above process is the best known and used for the conversion of engines for which various modifications are required, such as adapting an acceleration body, mounting gas and ignition supply systems and reducing the compression ratio. However, a clear disadvantage of this process is the disassembly and permanent modification of the piston, so that the installation times are increased and it is not a reversible process. In fact, this change in the volume of the piston causes it to weaken and when the engine is need to run again with diesel, new pistons are required. Despite the evidences in the processes that are carried out to reduce the compression ratio, there is no evidence that this process is made by metallization of the cylinder head and less that this process can be carried out for the conversion of engines.

Other documents relating to the invention are directly related with a spatter plate which is installed between the cylinder head and the cylinder block so that the compression in the diesel engine can be reduced, a spark source can be provided and the compression ratio can be reduced. A combustion chamber volume is generated by including such spatter plate, which reduces the compression ratio required to use natural gas as fuel. However, said spatter plate provides a spark source, which makes it complex and expensive, and is a thin element that is likely to fail because it has to support high pressures and temperatures that occur in the combustion chamber.

Likewise, some companies in different parts of Latin America have sought the conversion of diesel engines to natural gas, among which we can highlight Agesel SA and greenenergyperu located in Peru. The latter has been focused on the design and commercialization of machines (electric generators) and accessories therefor, which comprise a diesel generator (internal combustion engine) whose purpose is to generate energy. These two companies have used modified pistons for the reduction of the compression of the engine and mechanical mixers instead of electronic injectors for the fuel supply. In Colombia, despite the fact that the development of processes for the modification and conversion of diesel engines to natural gas has been more important today, this is an untapped market due to the current restriction of the efficient supply of natural gas throughout the country and the high costs due to the conversion (around 11 million of Colombian pesos in 2006).

Considering that the most commonly used options for converting engines are those referred to above, there is still a need for a process allowing the conversion of a diesel engine to a natural gas engine at a low cost in order to reduce pollutant emissions, without the need of an internal modification of the engine and that can be easily reversible. In this sense and in order to solve this problem, the present invention describes a process suitable for the reversible conversion of an internal combustion engine so that it efficiently operates fueled with natural gas by adding cold material in the engine head.

GENERAL DESCRIPTION OF THE INVENTION

Considering the present need to reduce pollutant emissions and operating costs in internal combustion engines, the present invention relates to a process for converting a diesel engine to a natural gas engine.

The process discussed in the present invention consists in increasing the size of the combustion chamber on the engine head, this process decreases the costs and process times, and also prevents the structural reliability of the engine to be affected, besides being easily reversible. Lower costs are associated with less engine disassembly and less component intervention.

DETAILED DESCRIPTION OF THE INVENTION

The process proposed in the present invention allows the conversion of a diesel engine to natural gas by adding cold material to the cylinder head.

The process described in the present invention consists in increasing the size of the combustion chamber on the engine head by adding cold material, this process decreases the costs and process times compared to the extraction of material from the pistons, besides not affecting the structural reliability of the engine and being easily reversible, and compared to that of the separation sheet is the reliability of the engine since the sheet is usually a very thin element that is likely to fail, while the addition of material to the cylinder head behaves as a single piece, i.e., as the original element.

In order to carry out this process, the calculations are initially conducted to know the filler thickness needed so as the desired engine have the compression ratio required to optimally work with the new fuel. The calculation for determining the filler thickness uses the following formula:

$$e_r - \frac{V_{oil} + V_{cam}(1 - R_{cf})V_{emp}(1 - R_{cf})}{(R_{cf} - 1) * \pi * \frac{d^2}{4}}$$

wherein:

d: cylinder diameter; c: career; e: packing thickness;

$$V_{oil} = \pi * c * \frac{d^n}{4};$$

Vcam volume of the combustion chamber that the piston has and the cylinder head is obtained by supplying a fluid from a calibrated cylinder until these volumes are completely filled, it is advisable to use an acrylic or the like in the upper part with a perforation where the fluid can be added, and the deposited amount thereof corresponds to the volume of the camera (Vcam);

$$V_{emp} = \pi * e * \frac{d^2}{4};$$

RCf is the one that the engine must have to operate with natural gas as fuel, this value is between 12 and 16 depending on the characteristics of each engine (12-14 for supercharged engines and 14-16 for natural aspiration engines).

Figure 1:
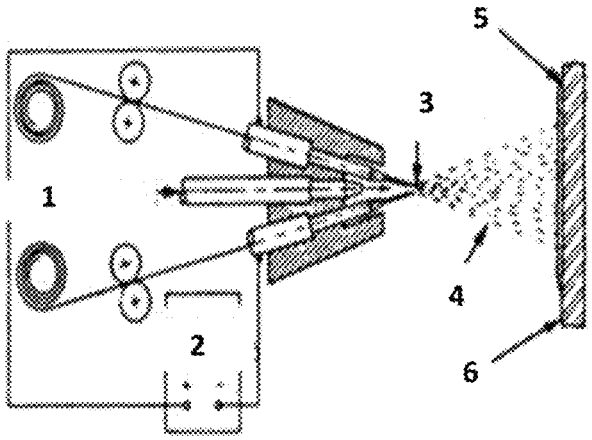
FIG. 1 shows the arc spraying process where the sprayed metal reaches the base material by an sprayed jet passing through an electric arc.
Figure 2:
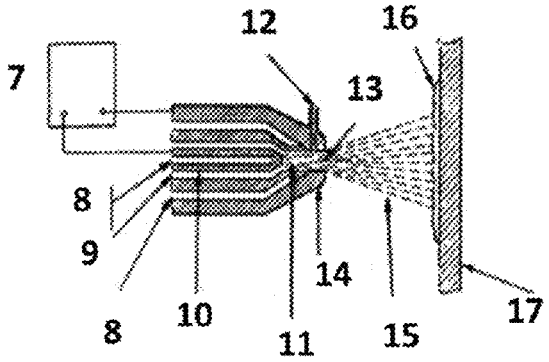
FIG. 2 describes the plasma spraying process wherein the sprayed metal reaches the base material after passing through an arc generating a dust spray suspended in a carrier gas and reaching the base material by a spray stream.

The engine head is then disassembled according to the particular specifications given by the manufacturer. Subsequently, the addition of the cold material is carried out by a process known as metallization or spraying. This process can be carried out by arc spraying or plasma spraying, as indicated in FIGS. 1 and 2, respectively.

In a preferred embodiment, the process of adding the cold material by electric arc spraying comprises compressed air (1), a power supply (2), which allows the compressed air (1) to pass through an electric arc (3) so that a sprayed jet is produced (4), wherein the sprayed material (5) is deposited on the base material (6). This process can be observed in FIG. 1.

In another preferred embodiment, the cold material addition process is performed by plasma spraying, wherein a DC power supply (7) is connected to a coolant circulation (8) through which a plasma gas (9) passes through an electrode (10). The plasma gas 9 then passes through an arc (11) where it is mixed with a dust jet suspended in a carrier gas (12) producing a plasma flame (13) in a nozzle (14) which in a spray stream (15) deposits the sprayed material (16) onto the base metal (17). This process can be observed in FIG. 2.

The cold material and the conditions required to carry out the cold material addition by arc spraying or plasma spraying will depend on the specifications given by the manufacturer for each type of engine to be converted and, therefore, of the material of the cylinder head on which the process will be performed. Also, this step from the process claimed will also depend on the equipment and the reference thereof with which the addition of the cold material is carried out, since the conditions may vary according to the specifications given by the manufacturer. In this way, a person with average skills in the art would understand that the development of the step of adding cold material will be subject to the specific conditions of the equipment used to convert the desired engine.

Figure 3:
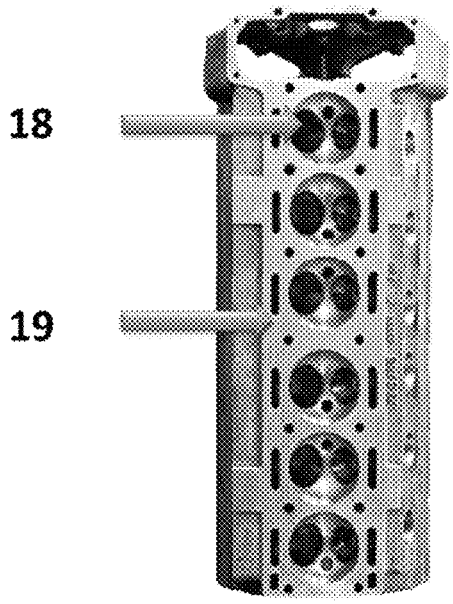
FIG. 3 shows the final result of the finished combustion chamber and the machined surface after the polishing of the combustion chamber and surface machining.
Figure 4:
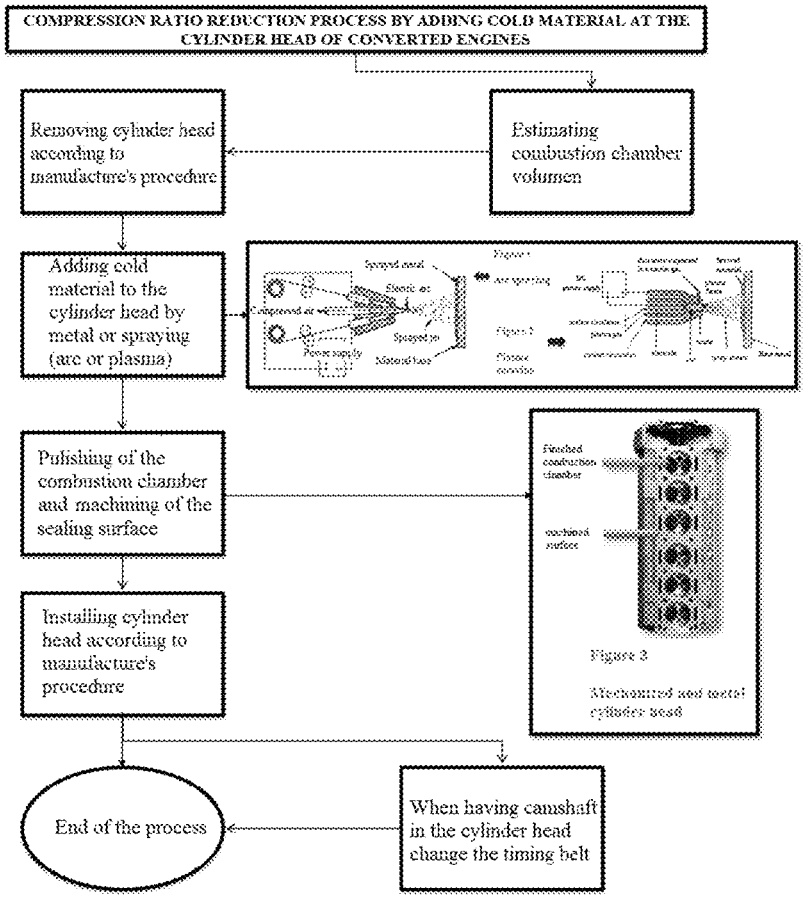
FIG. 4 shows the process of reducing the compression ratio by means of adding cold material in the cylinder head for converted engines.

In general terms, in the spraying process the cylinder head should be brushed, and then covered with tapes and special products so as to prevent it from being adhered with the sprayed material, such as in the chamber to be formed, lubrication and cooling ducts, among others, then a layer of base material is sprayed and then the filler material. The result of this process is the formation of a combustion chamber on the seal surface of the cylinder head protecting the area of the valve seats, as seen in FIG. 3. It is important to note that after this process the cylinder heads must be completely flat, that is why the cylinder head must then go through a machining process where the finishing of the combustion chambers is polished and the finish of the sealing surface is also polished; the final result is as shown in FIG. 3. By completing the process, the cylinder head is reinstalled in the engine, bearing in mind that if the converted engine has a camshaft over the cylinder head, the adjustment plate must be modified so that the timing belt does not overtighten as described in FIG. 4. Considering the reversible nature of the process described in the present invention, if the engine is required to be use fueled again with diesel, it is possible to carry out a process called brushing, so that the added material can be easily removed.

As shown in the final finish (FIG. 3) the resulting cylinder head is a single solid part that works just like the original one, with no thin and weak elements between the cylinder head and the cylinder block failing easily, and without pistons weakening. FIG. 3 shows the finished combustion chamber (18) and the machined surface (19) in the cylinder head of the engine. In fact, the process described in the present invention allows to repair significant buckling or wear problems on cylinder heads until they are fully recovered. Likewise, and without causing any problems, the process claimed has been applied to competition engines, wherein said engines are highly pushed to the limit as they are supercharged with turbo-compressor. In contrast, and by employing processes similar to those disclosed in the state of the art, where separation sheets or irreversible modification of the piston are employed in order to reduce the compression ratio, there were no satisfactory results presenting drawbacks in a 40% of cases where they were tested.

Differences in this process, with respect to the process conventionally performed, are mainly based on the reliability of the operation of the engine that was modified, and it has to be also taken into account that the process where the engine pistons are modified by removing material requires the engine to be completely taken apart and the need of more elements, which entails a greater cost and time, compared to the process discussed in the present invention. In addition to the above, the proposed process can be easily reversible, i.e., the engine will be able to run again with diesel as fuel, since it only requires removing the material added to the cylinder head by means of a brushing process, which is a process well known by a person skilled in the art.

The invention claimed is:

1. A process for converting a diesel internal combustion engine having a cylinder head, a combustion chamber, a sealing surface and valve seats to natural gas, the process comprising:

a) performing compression ratio calculations for obtaining the combustion chamber volume required for a gas-fuel engine;

b) removing the cylinder head of the internal combustion engine;

c) adding cold material into the cylinder head of the internal combustion engine by a metallization process on the sealing surface, protecting thus an area of the valve seats by forming an additional combustion chamber;

d) subjecting the modified cylinder head of the internal combustion engine to a machining process, which will allow the combustion chambers and the sealing surface to be polished;

e) reinstalling the modified cylinder head of the internal combustion engine.

2. The process for converting an engine according to claim 1, wherein the metallization process is performed by arc-spraying.

3. The process for converting an engine according to claim 1, wherein the metallization process is performed by plasma spraying.

4. The process for converting an engine according to claim 1, wherein in step e) if the engine contains a camshaft on0 the cylinder head a lightener is adjusted so that cam belts will not be tighten more than necessary.

* * * * *